United States Patent [19]

Foy et al.

[11] 3,958,700

[45] May 25, 1976

[54] CHARGING MACHINES

[75] Inventors: Wilfred Francis Foy, Salford; Lewis Ainsley Watson, Caarbrook, Stalybridge, both of England

[73] Assignee: Simon-Carves Limited, Great Britain

[22] Filed: June 21, 1974

[21] Appl. No.: 481,760

[30] Foreign Application Priority Data

July 9, 1973 United Kingdom ..... 32663/73

[52] U.S. Cl. ..... 214/35 R; 141/284; 193/30; 202/262; 214/18 PH

[51] Int. Cl.[2] ..... B66C 17/08; C10B 31/04

[58] Field of Search ..... 214/18 PH, 35 R, 17 B, 214/17 C; 193/30; 141/284, 392; 202/262, 263

[56] References Cited

UNITED STATES PATENTS

| | | | |
|---|---|---|---|
| 502,194 | 7/1893 | Johnston | 193/30 |
| 3,173,459 | 3/1965 | Gooding | 214/17 C X |
| 3,576,263 | 4/1971 | Abendroth | 214/35 R |
| 3,764,026 | 10/1973 | Olah | 214/18 PH X |
| 3,799,223 | 3/1974 | Feneziani | 193/30 X |
| 3,857,758 | 12/1974 | Mole | 214/18 PH X |

*Primary Examiner*—Robert G. Sheridan
*Attorney, Agent, or Firm*—Norris & Bateman

[57] ABSTRACT

A charging machine of the kind comprising a structure adapted to extend transversely of a coke oven battery on the roof thereof for movement longitudinally of the battery to overlie any selected oven chamber and supporting a number of hoppers adapted to be filled with coking coal, each such hopper having means for connecting the base thereof with an aperture in the roof of an oven chamber for transfer of coking coal from the hopper to the oven chamber, wherein said means for connecting the base of each hopper with an aperture in the roof of an oven chamber comprises a downwardly directed telescopically extendible sleeve, characterized by the provision of an annular seal outwardly spaced from and surrounding the lower end of said sleeve and adapted to engage with the oven roof surrounding an aperture in an oven chamber on lowering of said sleeve, there being gas tight resilient means connecting said seal with said sleeve, and arranged to urge the seal downwardly into engagement with the roof of the oven chamber.

13 Claims, 3 Drawing Figures

CHARGING MACHINES

This invention concerns charging machines for coke oven batteries and being of the kind (hereinafter termed of the kind referred to) comprising a structure adapted to extend transversly of a coke oven battery on the roof thereof for movement longitudinally of the battery to overlie any selected oven chamber and supporting a number of hoppers adapted to be filled with coking coal, each such hopper having means for connecting the base thereof with an aperture in the roof of an oven chamber for transfer of coking coal from the hopper to the oven chamber.

Due to increasingly stringent standards for prevention of atmospheric pollution, it is important that the emission of dust and gases during the charging of coke ovens is minimised. For this reason it is usual for the means adapted to connect the base of the coking coal containing hoppers of a charging machine of the kind referred to with the apertures in the roof of an oven chamber, to include means for forming a seal around such apertures.

Various kinds of sealing means have been proposed but many, whilst reducing the emission of dust and gases to the atmosphere, do not meet the present requirements.

It is an object of the present invention to provide improved sealing means for this purpose.

According to the present invention a charging machine of the kind referred to wherein said means for connecting the base of each hopper with an aperture in the roof of an oven chamber comprises a downwardly directed telescopically extendible sleeve, is characterised by the provision of an annular seal outwardly spaced from and surrounding the lower end of said sleeve and adapted to engage with the oven roof surrounding an aperture in an oven chamber on lowering of said sleeve, there being gas tight resilient means connecting said seal with said sleeve, means arranged to urge the seal downwardly into engagement with the roof of the oven chamber and complimentary seals on the parts of the telescopically extendible sleeve which sealingly engage when the sleeve is fully downwardly extended.

The invention will be further apparent from the following description with reference to the figures of the accomanying drawings which show, by way of example only, two forms of a charging machine embodying the invention.

Figure 3:
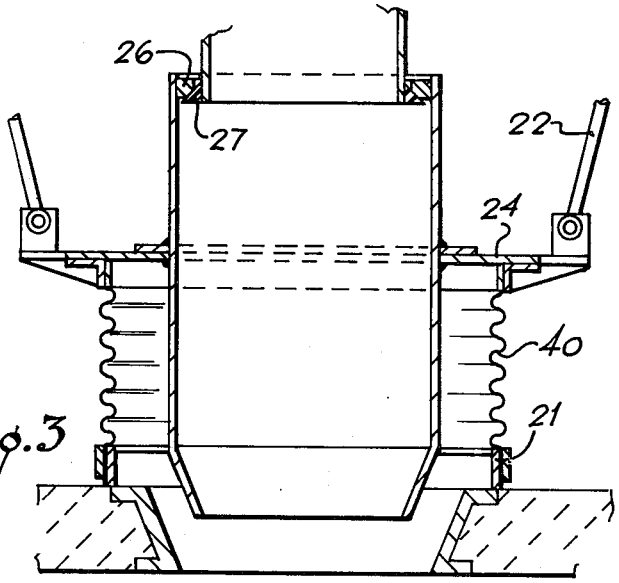
Figure 2:
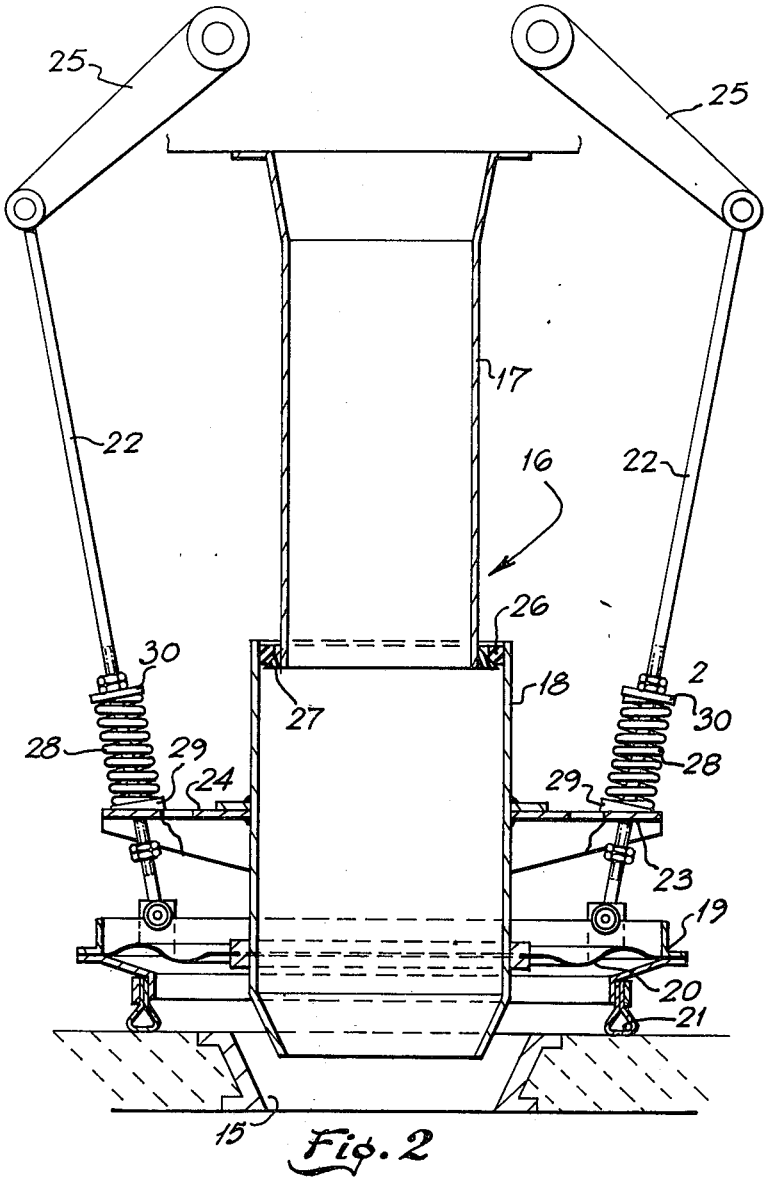
FIG. 2 shows an enlarged cross sectional view through the means for connecting the hoppers of the charging machine of FIG. 1 with the apertures in the roof of an oven chamber.

and FIG. 3 shows a fragmentary view similar to that of FIG. 2 of alternative means having a modified construction.

Figure 1:
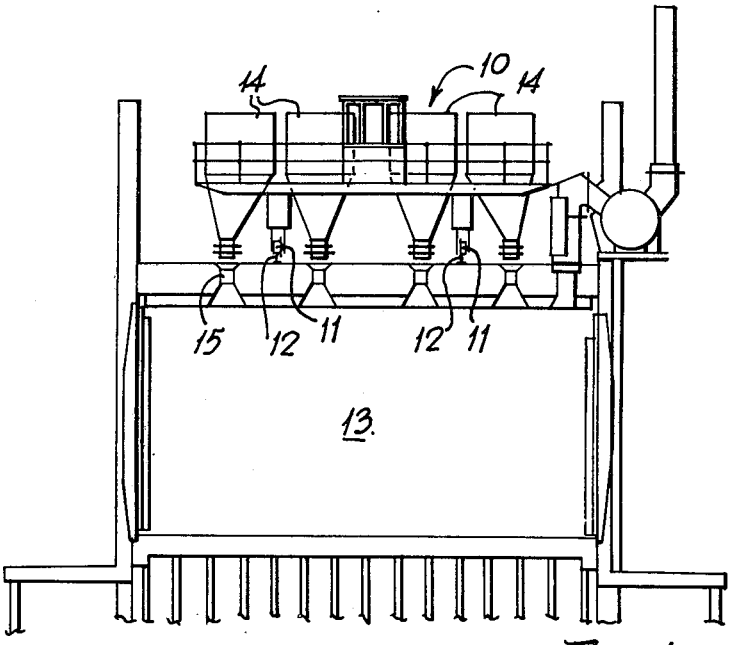
FIG. 1 shows a diagramatic transverse cross section through the upper part of a coke oven battery showing a charging machine in position on the roof thereof.

Referring now to the drawings, and more particularly FIGS. 1 and 2 thereof, it will be seen that the charging machine which is generally indicated by the reference numeral 10 comprises, in known manner, a structure extending transversely of the oven battery and supported on wheels 11 engaging rails 12 extending longitudinally of the oven battery whereby the machine 10 may be moved longitudinally of the battery to a position overlying any selected one of the individual oven chambers 13. The charging machine 10 carries a plurality of hoppers 14, the number thereof corresponding with the number of charge holes 15 in the roof of the oven chamber 13. In known manner the machine 10 includes means for lifting the covers to the holes 15 when it is aligned over an oven 13 for the purpose of charging the oven.

Referring now to FIG. 2 it will be seen that a downwardly directed telescopically extendible sleeve arrangement generally indicated at 16 is provided beneath the outlet from each of the hoppers 14 for the purpose of connecting same with one of the holes 15 in the roof of an oven chamber 13.

The sleeve arrangement 16 comprises a first tube 17 fixedly secured to the underside of the hopper 14 and a second tube 18 of larger diameter telescopically slideable over the tube 17. An annular frame member 19 surrounds the tube 18 adjacent the lower end thereof and is secured to the tube 18 by means of an annular seal 20 formed by a flexible and resilient diaphragm made from steel, wire reinforced asbestos or other suitable material. A further annular seal 21 is provided on the underside of the frame member 19 so as to project downwardly therefrom. The seal 21 is compressible and formed from wire reinforced asbestos or wire reinforced ceramic fibre for example.

Three actuating rods 22 (only two of which are shown in the drawing) are provided at equally angularly spaced intervals around the frame member 19.

The rods 22 are pivotally connected to the member 19 and extend upwardly therefrom to pass through apertures 23 in a further annular frame member 24 secured around the periphery of the tube 18 at a higher level than the frame member 19, and are pivotally connected at their upper ends to levers 25 which can be operated by hydraulic cylinders or other actuating means.

In use, when the rods 22 are in an upper position, the tube 18 is raised to surround the tube 17. When the charging machine is correctly located over an oven chamber 13 and the covers from the holes 15 have been removed, the rods 22 are lowered by means of the levers 25 to extend the sleeve arrangement 16 downwardly. Downward movement of the tube 18 is arrested when an annular seal 26 located at its upper end on the inner periphery thereof engages with an annular seal 27 located on the outer periphery of the tube 17 at its lower end. Compression springs 28, whose lower ends are located on blocks 29 carried on the upper surface of the member 24 and surrounding the rods 22 and having their upper ends engaged by discs 30 fixed to rods 22, are provided.

Continued movement of the rods 22 downwardly causes the frame member 19 to be moved downwardly relative to the tube 18 to bring the seal 21 into firm engagement with the roof of the oven chamber surrounding the hole 15. The resulting compression in the springs 28 holds the seals 26 and 27 in firm sealing engagement.

We have found that the arrangement described forms a very adequate seal with the roof of the oven chamber and between the tubes 17 and 18, and that irregularities in the roof surface do not prevent the formation of such seal.

The arrangement shown in FIG. 3 is generally similar to that shown in FIG. 2 but the diaphragm 20 and frame 19 are replaced by a cylindrical bellows structure 40 extending between the annular seal 21 and underside of the frame member 24, the control rods 22 then being pivotally connected to the frame member 24 and the springs 28 being omitted. In this embodiment downward movement of the rods 22 carries the seal 21 into engagement with the roof. Continued movement brings the seals 26 and 27 into engagement whilst compressing the bellows structure 40 thereby urging the seal 21 downwardly in a resilient manner.

It will be appreciated that it is not intended to limit the invention to the above examples only, many variations. such as might readily occur to one skilled in the art, being possible without departing from the scope thereof.

Thus, for example, the annular seals 21 may be of rigid construction, complementary annular channels filled with sand being provided in the roof of the oven chamber around each charge hole 15. Such channels would have a depth such that no point on the periphery of the seal 21 would reach the base of the channel when the seal 21 is in its lowermost sealing position with the seal in the sand filling the channel.

What is claimed is:

1. A charging machine for coke oven batteries comprising a structure adapted to extend transversely of a coke oven battery on the roof thereof for movement longitudinally of the battery to overlie any selected oven chamber and supporting a number of hoppers adapted to be filled with coking coal, each such hopper having means for connecting the base thereof with an aperture in the roof of an oven chamber for transfer of coking coal from the hopper to the oven chamber, and said means for connecting the base of each hopper with an aperture in the roof of an oven chamber comprising a downwardly directed telescopically extendible sleeve, characterized by the provision of an annular seal outwardly spaced from and surrounding the lower end of said sleeve and adapted to engage with the oven roof surrounding an aperture in an oven chamber on lowering of said sleeve, there being gas tight resilient means connecting said seal with the lower end of said sleeve means for urging said annular seal downwardly into engagement with the roof of the oven chamber, said downwardly directed telescopically extendible sleeve comprising a lower part which is adapted to be raised and lowered relative to an upper part secured to the charging machine, and an annular frame from which said annular seal protrudes downwardly surrounding said lower part of the sleeve, said resilient means being comprised by a flexible diaphragm which closes the annular spaced defined between the outer periphery of said lower part of the sleeve and said annular frame.

2. A charging machine according to claim 1 wherein said diaphragm is formed from wire reinforced asbestos.

3. A charging machine according to claim 1 wherein said diaphragm is formed from steel.

4. A charging machine according to claim 1 wherein complementary seals are provided on the lower and upper parts of said sleeve and which come into sealing engagement when said lower part is moved to its bottom position.

5. A charging machine according to claim 4 wherein lever means are provided for lowering said lower part to bring said complementary seals into engagement and for carrying said annular seal into engagement with the roof of the oven chamber.

6. A charging machine according to claim 5 wherein compression springs are associated with said lever means whereby said complementary seals are held in pressurised engagement.

7. A charging machine according to claim 1 wherein said annular seal is compressible and formed from a wire reinforced fibrous material.

8. A charging machine for coke oven batteries comprising a structure adapted to extend transversely of a coke oven battery on the roof thereof for movement longitudinally of the battery to overlie any selected oven chamber and supporting a number of hoppers adapted to be filled with coking coal, each such hopper having means for connecting the base thereof with an aperture in the roof of an oven chamber for transfer of coking coal from the hopper to the oven chamber, said means for connecting the base of each hopper with an aperture in the roof of an oven chamber comprising a downwardly directed telescopically extendible sleeve having a fixed upper part secured to the charging machine and a lower part which is adapted to be raised and lowered relative to said upper part, there being complimentary seals provided on the lower and upper parts of said sleeve which come into sealing engagement when said lower part is moved to its bottom position, an annular seal outwardly spaced from and surrounding the lower end of said sleeve and adapted to be lowered to engage with the oven roof surrounding an aperture in an oven chamber, there being gas tight resilient means connecting said annular seal with said lower part and there being means for lowering said lower part to bring said complimentary seals into pressurized sealing engagement and to lower said annular seal to being it into sealing engagement with the roof of the oven chamber, any variations in height between said complimentary seals and the roof of the oven chamber being accommodated by movement in said gas tight resilient means.

9. A charging machine according to claim 8 wherein said resilient means is comprised by a flexible diaphragm which closes an annular space defined between the outer periphery of said lower part of the sleeve and an annular frame from which said annular seal protrudes downwardly.

10. A charging machine according to claim 9 wherein said diaphragm is formed from wire reinforced asbestos.

11. A charging machine according to claim 9 wherein said diaphragm is formed from steel.

12. A charging machine according to claim 9 including lever means for lowering said annular seal into pressurized engagement with the roof of the oven chamber and which also act on resilient means for moving said lower part of the sleeve downwardly to bring said complimentary seals into sealing engagement.

13. A charging machine according to claim 8 including lever means for lowering said annular seal into pressurized engagement with the roof of the oven chamber and which also act on resilient means for moving said lower part of the sleeve downwardly to bring said complimentary seals into sealing engagement.

* * * * *